US012098731B1

(12) United States Patent
Shi

(10) Patent No.: US 12,098,731 B1
(45) Date of Patent: Sep. 24, 2024

(54) BIDIRECTIONAL AIR PUMP

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Dongguan (CN)

( * ) Notice: Subject to any disclaimer, the term of this patent is extended or adjusted under 35 U.S.C. 154(b) by 0 days.

(21) Appl. No.: 18/407,696

(22) Filed: Jan. 9, 2024

(30) Foreign Application Priority Data

Oct. 24, 2023 (CN) ..... 202322868752.7

(51) Int. Cl.
*F04D 29/50* (2006.01)
*F04D 29/42* (2006.01)
*F04D 29/60* (2006.01)

(52) U.S. Cl.
CPC ..... *F04D 29/503* (2013.01); *F04D 29/4226* (2013.01); *F04D 29/601* (2013.01)

(58) Field of Classification Search
CPC .. F04D 29/4226; F04D 29/503; A47C 27/082
USPC ..... 417/238, 239
See application file for complete search history.

(56) References Cited

U.S. PATENT DOCUMENTS 6,276,908 B1 * 8/2001 Batchelder ..... F04D 13/06 417/423.3
11,460,043 B2 * 10/2022 Qin ..... F04D 29/602
2015/0308454 A1 * 10/2015 Shi ..... F04D 27/008 415/151
2019/0301476 A1 * 10/2019 Huang ..... F04D 25/166
2022/0065257 A1 * 3/2022 Huang ..... F04D 27/008

* cited by examiner

*Primary Examiner* — Kenneth J Hansen
(74) *Attorney, Agent, or Firm* — Cooper Legal Group, LLC

(57) ABSTRACT

A bidirectional air pump, belonging to the technical field of air pump, includes a housing and a pump body, wherein an accommodating groove is defined on a side of the housing, the pump body is accommodated in the accommodating groove, a first air hole is defined on a bottom of the accommodating groove, the pump body comprises a casing and a wind assembly, the casing is hollowed-out, the wind assembly is arranged in the casing, an air inlet and an air outlet are respectively defined at two ends of the casing, and a position of the first air hole is aligned with a position of the air inlet and a position of the air outlet.

7 Claims, 2 Drawing Sheets

BIDIRECTIONAL AIR PUMP

CROSS-REFERENCE TO RELATED APPLICATION

This application is based on and claims the priority and benefits of Chinese patent application serial no. 202322868752.7, filed on Oct. 24, 2023. The entirety of Chinese patent application serial no. 202322868752.7 is hereby incorporated by reference herein and made a part of this specification.

TECHNICAL FIELD

The present application relates to a technical field of air pump, and in particular, to a bidirectional air pump.

BACKGROUND ART

Gas pump, also known as "air pump", is a device for exhausting air from or pumping air into an enclosed space. The air pump is mainly classified into electric air pump, hand air pump, and foot air pump. The electric air pump is an electricity-powered air pump, which continuously compresses air with electricity, to generate air pressure. The air pumps are mainly used for inflation, sewage treatment, air-blowing for electroplating, aeration of biogas digester, tunnel ventilation, and so on.

At present, the structure and function of some air pumps used for the inflatable mattresses are relatively single and usually are unidirectional pumps. When the inflatable mattress is stored, it is necessary to be punched separately for deflating, which has a lower deflating efficiency and is more troublesome.

SUMMARY

In order to improve the diversification of the structure and function of the air pump, the present application provides a bidirectional air pump.

The bidirectional air pump disclosed includes a housing and a pump body, wherein an accommodating groove is defined on a side of the housing, the pump body is accommodated in the accommodating groove, a first air hole is defined on a bottom of the accommodating groove, the pump body comprises a casing and a wind assembly, the casing is hollowed-out, the wind assembly is arranged in the casing, an air inlet and an air outlet are respectively defined at two ends of the casing, and a position of the first air hole is aligned with a position of the air inlet and a position of the air outlet.

By adopting the above technical solution, when the air pump is set forward, the wind assembly is started, the air enters through the air inlet and flows out from the air outlet while passing through the first air hole. Accordingly, when the air pump is taken out and turned around, the wind assembly is restarted, the air enters through the first air hole, and passes through the air inlet and the air outlet similarly. Thus air flow in opposite directions can be generated. Therefore, the air pump has the function of bidirectional air supply, indirectly improving the diversification of the structure and function of the air pump.

Optionally, a first deflation cover is slidingly arranged in the first air hole in its own axis direction, and the first deflation cover is configured for covering the first air hole.

By adopting the above technical solution, when the air pump acts on an object to be sealed, it can control the sliding of the first deflation cover to open or close the first air hole, thereby playing a sealing role.

Optionally, a side wall of the first deflation cover is fixed with a sliding rod, the sliding rod slides in the axis direction of the first air hole, an ejection block is arranged in the air inlet, and the ejection block is configured for ejecting the sliding rod.

By adopting the above technical solution, when the air inlet is close to the first air hole, the ejection block abuts against the sliding rod and ejects the sliding rod, to move the first deflation cover away from the first air hole, thereby opening the first air hole.

Optionally, a side of the housing departing from the accommodating groove is provided with a protective cap, an outer side of the first deflation cover is covered by the protective cap, a first reset spring is arranged in the protective cap, two ends of the first reset spring respectively abut against an inner wall of the protective cap and a side wall of the first deflation cover departing from the accommodating groove.

By adopting the above technical solution, after the first deflation cover is ejected, the first reset spring is compressed and contracted. When the ejection block moves far away from the sliding rod, the first deflation cover is pushed back to the first air hole under the elasticity of the first reset spring itself, thereby blocking the first air hole.

Optionally, a side of the housing departing from the accommodating groove is provided with a convex edge, an outer side of the convex edge is covered by the protective cap, a side wall of the convex edge is provided with a limit block, a limit groove is defined on the inner wall of the protective cap, and the limit block is in snap-in connection with the limit groove.

By adopting the above technical solution, the protective cap is rotated to unlock the limit block and the limit groove, such that the protective cap is easy to open. Similarly, the protective cap covers the outer side of the convex edge, and the protective cap is rotated in the opposite direction, so that the limit groove on the protective cap is in snap-in connection with the limit block on the convex edge. Therefore, a quick dismounting and mounting of the protective cap is achieved.

Optionally, a locking assembly is provided between the housing and the pump body, the locking assembly comprises a base, a sliding block, a second reset spring, a pressing block and a third reset spring, a received recess is defined in the housing, the base is installed in the received recess, the sliding block is slidingly arranged in the received recess in horizontal direction and penetrates a wall of the accommodating groove; a slot is defined on a side wall of the casing, the sliding block is inserted in the slot, the sliding block is reset by the second reset spring, the pressing block is slidingly arranged in the received recess in vertical direction, relative sliding inclined planes are provided on sides of the pressing block and the sliding block opposite to each other, and the third reset spring is configured to reset the pressing block.

By adopting the above technical solution, when the pressing block is pressed, the third reset spring is compressed and contracted, such that the sliding block moves relatively due to the relative sliding inclined planes on sides of the pressing block and the sliding block opposite to each other, thus the second reset spring is compressed and contracted, and the sliding block is detached from the slot, thereby lifting restriction on the pump body, such that the pump body is easy to be taken out.

Optionally, a second air hole is defined on the housing, the second air hole is in communication with the accommodating groove, the second air hole is covered with a second deflation cover, the housing is provided with a control assembly for controlling the second deflation cover to open and close.

By adopting the above technical solution, the second deflation cover is opened by the control assembly, thereby opening the second air hole and cooperating with the deflation of the first air hole, thus improving the deflating efficiency.

Optionally, the control assembly comprises a locking base, a locking block, a button and a fourth reset spring, the locking base is installed on an inner wall of the second air hole, a straight slot and an inclined slot are defined on an inner wall of the locking base circumferentially, a length of the straight slot is greater than a length of the inclined slot, the locking block and the button are slidingly arranged in the locking base, two ends of the fourth reset spring respectively abut against the second deflation cover and the locking block, an outer wall of the locking block and an end face of the button are respectively provided with first teeth and second teeth, the first teeth and the second teeth are meshed with each other, the first teeth are slidable in the straight slot or the inclined slot.

By adopting the above technical solution, when the button is pressed, the locking block begins to slide, and the fourth reset spring is compressed and contracted, causing the opening of the second deflation cover, and the second teeth on the button and the first teeth on the locking block would slide relative to each other. After the button is released, the first teeth on the locking block is snapped in the inclined slots under the elasticity of the fourth reset spring, such that the locking block is limited, thereby maintaining the second deflation cover in an open state, facilitating the deflation of the second air hole.

Optionally, a protective cover is rotationally arranged on an outer wall of the housing, and the protective cover covers the accommodating groove.

By adopting the above technical solution, the pump body is isolated from the outside by the protective cover, which can be protected well.

Optionally, the pump body further comprises a lighting assembly at an end face of the casing.

By adopting the above technical solution, after the pump body is taken out, the pump body can be used for a lighting tool with the lighting assembly, which further embodies the function diversification of the air pump.

In summary, at least one of the following beneficial technical effects is achieved:

1. Airflow in opposite directions can be generated, such that the air pump has the function of bidirectional air supply, thereby indirectly improving the diversification of the structure and function of the air pump;
2. the control assembly controls the second deflation cover to open, so as to open the second air hole, which cooperates with the deflation of the first air hole, thereby improving the deflating efficiency;
3. after the pump body is taken out, the pump body can be used for a lighting tool with the lighting assembly, which further embodies the function diversification of the air pump.

DETAILED DESCRIPTION

Figure 1:
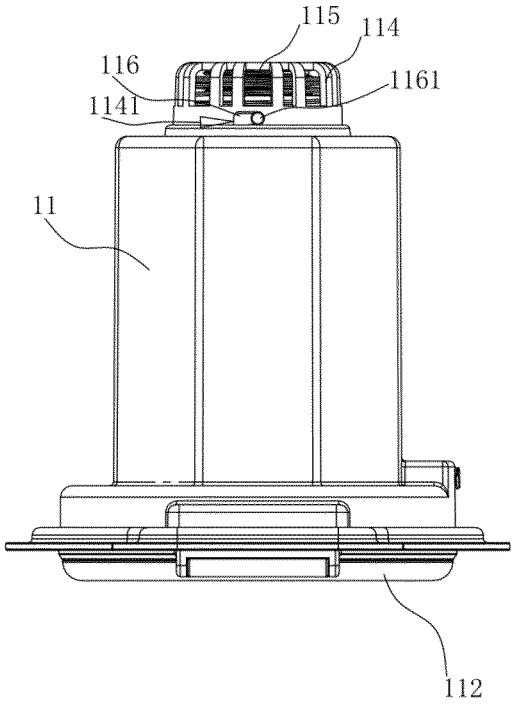
FIG. 1 is a perspective view of the overall structure of the embodiment of the present application.

The present application is further described in detail below in combination with FIGS. 1-3.

The embodiments of the present application provides a bidirectional air pump. Referring to FIG. 1 and FIG. 2, a bidirectional air pump includes a housing 1 and a pump body 2, an accommodating groove 111 is defined in the surface of the housing 1, the cross-section of the accommodating groove 111 is regular octagon, and the pump body 2 is accommodated in the accommodating groove 111. The housing 1 is used as a carrier of the pump body 2, and the pump body 2 is configured as the power source of the bidirectional air pump.

Figure 2:
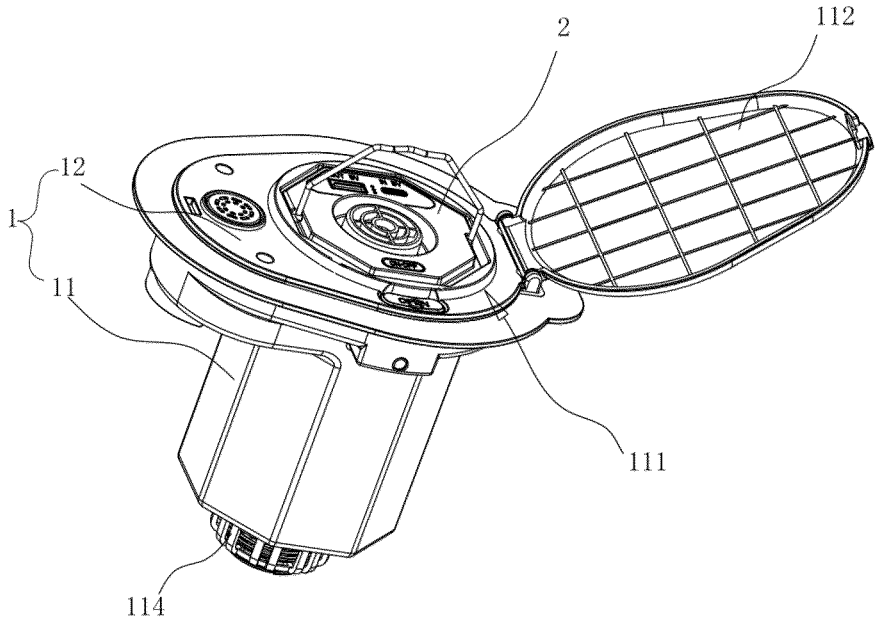
FIG. 2 is a view showing the structure of the embodiment of the present application after the protective cover is opened.
Figure 3:
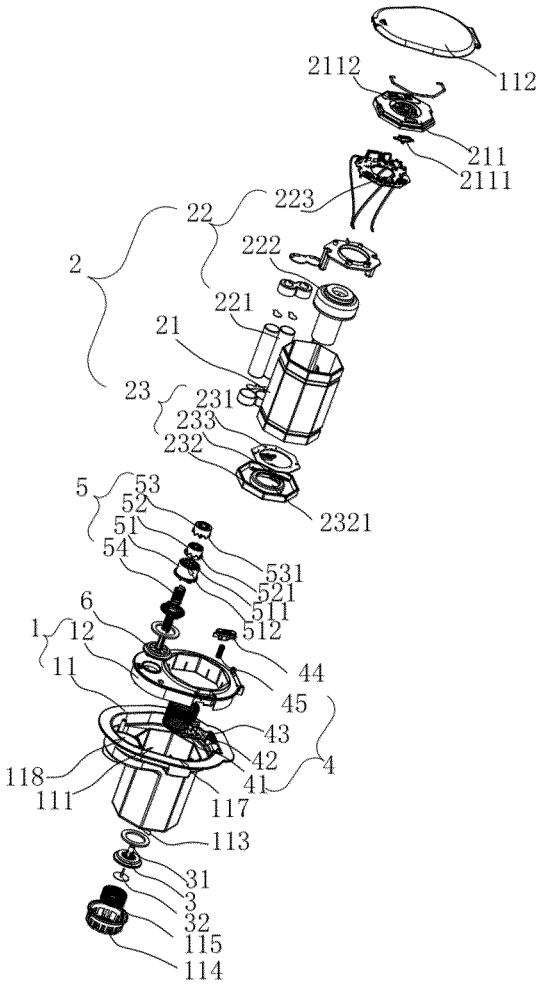
FIG. 3 is an exploded view of the embodiment of the present application.

Referring to FIG. 2 and FIG. 3, specifically, the housing 1 includes an outer shell 11 and a cover 12, a circular groove is defined on the surface of the outer shell 11, the cover 12 is scarfed in the circular groove, and the cover 12 is fixed to the outer shell 11 with screws. Meanwhile, the accommodating groove 111 is correspondingly defined at the outer shell 11, and the accommodating groove 111 correspondingly penetrates the cover 12.

Further, the outer wall of the outer shell 11 is rotationally provided with a protective cover 112, the protective cover 112 covers the accommodating groove 111. The pump body 2 is isolated from the outside by the protective cover 112, which can protect the pump body 2.

In another aspect, the pump body 2 includes a casing 21 and a wind assembly 22, the shape of the casing 21 is matched with the shape of the accommodating groove 111, the casing 21 is hollow inside, and the wind assembly 22 is arranged inside the casing 21. Specifically, the wind assembly 22 includes a battery pack 221, a fan motor 222 and a control circuit board 223. The battery pack 221, the fan motor 222 and the control circuit board 223 are electrically connected with each other. The battery pack 221, the fan motor 222 and the control circuit board 223 are arranged along the axis of the casing 21. Simultaneously, the top of the casing 21 is provided with a function panel 211, the top surface of the function panel 211 is provided with a fan switch for triggering the component on the control circuit board 223.

Furthermore, the pump body 2 also includes a lighting assembly 23. The lighting assembly includes a lighting motherboard 231, a lampshade 232 and a lighting switch 233, the lighting motherboard 231 is placed in the casing 21, the lighting motherboard 231 is electrically connected with the battery pack 221, the lampshade 232 covers the bottom of the casing 21, the lighting switch 233 is scarfed in the lampshade 232.

Accordingly, after the pump body 2 is taken out, the lighting switch 233 is pressed, which triggers the components on the lighting motherboard 231, to turn on the LED on the lighting motherboard 231, such that the pump body 2 can also be functioned as a lighting tool in addition to its basic inflation function, which further embodies the function diversification of the air pump.

Specifically, an air inlet 2111 is defined in the function panel 211, and an air outlet 2321 is defined in the bottom of the lampshade 232. Correspondingly, a first air hole 113 is defined in the bottom of the accommodating groove 111, which passes through the surface of the outer shell 11, and the position of the first air hole 113 is aligned with and corresponding to that of the air inlet 2111 and that of the air outlet 2321. In the power supply process of the battery pack 221, the fan switch on the surface of the function panel 211 is pressed by the operators, such that the components on the control circuit board 223 are triggered, so as to control the fan motor 222 to start, such that the airflow flows into the casing 21 through the air inlet 2111, and then flows out from the air outlet 2321.

Therefore, when the air pump is set forward, the wind assembly 22 is started, the air enters through the air inlet 2111 and flows out from the air outlet 2321 while passing through the first air hole 113. Accordingly, when the air pump is taken out and turned around, the wind assembly 22 is restarted, the air enters through the first air hole 113, and passes through the air inlet 2111 and the air outlet 2321 similarly, thereby generating air flow in the opposite direction. Therefore, the air pump has the function of bidirectional air supply, indirectly improving the diversification of the structure and function of the air pump.

Furthermore, a first deflation cover 3 is slidingly arranged in the first air hole 113 along its own axis direction, and the first deflation cover 3 is configured to cover the first air hole 113. The side wall of the first deflation cover 3 facing the accommodating groove 111 is fixed with a sliding rod 31. Accordingly, the air inlet 2111 is formed by a plurality of holes arranged in a grid shape, an ejection block 2112 is disposed in the air inlet 2111, which is configured for ejecting the sliding rod 31.

Accordingly, after the casing 21 is inserted in the accommodating groove 111, the ejection block 2112 abuts against and ejects the sliding rod 31 when the air inlet 2111 is close to the first air hole 113, such that the first deflation cover 3 moves far away from the first air hole 113, and the first air hole 113 is opened.

In addition, the holes, which are arranged in a grid shape, are also defined in the side wall of the first deflation cover 3, the side wall of the first deflation cover 3 departing from the sliding rod 31 is detachably connected with an inflation valve leather made of rubber with a certain softness.

Therefore, after the casing 21 is inserted in the accommodating groove 111, the wind assembly 22 is correspondingly started when the air outlet 2321 is close to the first air hole 113, the wind generated from the air outlet 2321 blows the inflation valve leather 32 open, namely, the inflation valve leather 32 can be deformed to open the hole on the surface of the first deflation cover 3, thereby achieving the air inflow.

Further referring back to FIG. 1 and FIG. 2, a side of the outer shell 11 departing from the accommodating groove 111 is provided with a protective cap, which is hollowed-out. The protective cap 114 covers the outer side of the first deflation cover 3. A first reset spring 115 is arranged in the protective cap 114, and two ends of the first reset spring 115 respectively abuts against the inner wall of the protective cap 114 and the side wall of the first deflation cover 3 departing from the accommodating groove 111.

At the same time, the side of the outer shell 11 departing from the accommodating groove 111 is provided with a convex edge 116 which is arranged around the first air hole 113, the protective cap 114 covers the outer side of the convex edge 116. The side wall of the convex edge 116 is provided with a limit block 1161, the inner wall of the protective cap 114 is configured with a limit groove 1141, the cross-section of the limit groove 1141 is L-shaped, and the limit block 1161 is in snap-in connection with the limit groove 1141.

Accordingly, the protective cap 114 is rotated to unlock the limit block 1161 and the limit groove 1141, such that the protective cap 114 is easy to open. Similarly, the protective cap 114 covers the outer side of the convex edge 116, and the protective cap 114 is rotated in the opposite direction, so that the limit groove 1141 on the protective cap 114 is in snap-connection with the limit block 1161 on the convex edge 116. Therefore, a quick dismounting and mounting of the protective cap 114 is achieved.

Simultaneously, after the first deflation cover 3 is ejected, the first reset spring 115 is compressed and contracted. When the ejection block 2112 moves far away from the sliding rod 31, the first reset spring 115 delivers the first deflation cover 3 back to the first air hole 113 under the elasticity of the first reset spring itself, thereby blocking the first air hole 113.

In another aspect referring to FIG. 2 and FIG. 3, a locking assembly 4 is provided between the outer shell 11 and the casing 21, the locking assembly 4 includes a base 41, a sliding block 42, a second reset spring 43, a pressing block 44 and a third reset spring 45. A received recess 117 is defined in the outer shell 11. In the present embodiment, the received recess 117 is formed by the block structures on the inner wall of the accommodating groove 111 matched with each other, the base 41 is installed in the received recess 117, the sliding block 42 is slidingly arranged in the received recess 117 in horizontal direction, and penetrates the wall of the accommodating groove 111. A slot is defined on the side wall of the casing 21, the sliding block 42 is inserted in the slot, the sliding block 42 is reset by the second reset spring, and the pressing block 44 is slidingly arranged in the received recess 117 in vertical direction. Relative sliding inclined planes are provided on sides of the pressing block 44 and the sliding block 42 opposite to each other, and the pressing block 44 is reset by the third reset spring 45.

Accordingly, when the pressing block 44 is pressed, the third reset spring 45 is compressed and contracted, such that the sliding block 42 moves relatively due to the relative sliding inclined planes on sides of the pressing block 44 and the sliding block 42 opposite to each other, thus the second reset spring 43 is compressed and contracted, and the sliding block 42 is detached from the slot, thereby lifting restriction on the pump body 2, such that the pump body 2 is easy to be taken out. Similarly, when the casing 21 is inserted in the accommodating groove 111, the sliding block 42 is squeezed by the outer wall of the casing 21, and the sliding block 42 in turn squeezes the second reset spring 43 correspondingly. When the casing 21 moves to the corresponding installation position, the sliding block 42 is aligned with the slot, the sliding block 42 is snapped in the slot under the elasticity of the second reset spring 43, achieving the relative fixation of the pump body 2 and the housing 1.

In another aspect, a second air hole 118 is defined on the side wall of the outer shell 11, the second air hole 118 is located at a side of the first air hole 113 and in communication with the accommodating groove 111, the second deflation cover 6 covers the second air hole 118, and a control assembly 5 is provided at the housing 1, which is configured for controlling the second deflation cover 6 to open and close.

Specifically, the control assembly 5 includes a locking base 51, a locking block 52, a button 53 and a fourth reset spring 54, the locking base 51 is installed at the inner wall of the second air hole 118. A straight slot 511 and an inclined slot 512 are defined on the inner wall of the locking base 51 circumferentially, the quantity of the straight slots 511 and that of the inclined slots 512 are both five, the straight slots 511 and the inclined slots 512 are arranged at intervals, and the length of the straight slot 511 is greater than that of the inclined slot 512. The locking block 52 and the button 53 are both slidingly disposed in the locking base 51. Two ends of the fourth reset spring 54 respectively abut against the second deflation cover 6 and the locking block 52. The outer wall of the locking block 52 and the end face of the button 53 are respectively provided with first teeth 521 and second teeth 531, the first teeth 521 and the second teeth 531 are meshed with each other, and the first teeth 521 are slidable in the straight slots 511 or the inclined slots 512.

Correspondingly, when the button 53 is pressed, the locking block 52 begins to slide, and the fourth reset spring 54 is compressed and contracted, causing the opening of the second deflation cover 6, and the second teeth 531 on the button 53 and the first teeth 521 on the locking block 52 would slide relative to each other. After the button 53 is released, the first teeth 521 on the locking block 52 is snapped in the inclined slots 512 under the elasticity of the fourth reset spring 54, such that the locking block 52 is limited, thereby maintaining the second deflation cover 6 in an open state, facilitating the deflation of the second air hole 118.

It should be noted that the control assembly 5 in the embodiments of the present application is similar to the locking structure of the ball-point pen in the existing technique, which is used mainly for locking and fixing the second deflation cover 6, and will not be further elaborated here.

The embodiment principle of the bidirectional air pump in the embodiments of the present application is as follows.

When the air pump is set forward, the wind assembly 22 is started, such that the air enters through the air inlet 2111 and flows out from the air outlet 2321 while passing through the first air hole 113. Accordingly, the air pump is taken out and turned around, when the wind assembly 22 is restarted, the air enters through the first air hole 113, and passes through the air inlet 2111 and the air outlet 2321 similarly. Thus, air flow in opposite directions can be generated. Therefore, the air pump has the function of bidirectional air supply, which indirectly improves the diversification of the structure and function of the air pump.

The above are the optional embodiments of the present application, which are not intended to limit the protection scope of the present application. Therefore, all equivalent changes made according to the structure, shape and principle of the present application should be covered within the protection scope of the present application.

LISTING OF REFERENCE SIGNS

1 housing
11 outer shell
111 accommodating groove
112 protective cover
113 first air hole
114 protective cap
1141 limit groove
115 first reset spring
116 convex edge
1161 limit block
117 received recess
118 second air hole
12 cover
2 pump body
21 casing
211 function panel
2111 air inlet
2112 ejection block
22 wind assembly
221 battery pack
222 fan motor
223 control circuit board
23 lighting assembly
231 lighting motherboard
232 lampshade
2321 air outlet
233 lighting switch
3 first deflation cover
31 sliding rod
32 inflation valve leather
4 locking assembly
41 base
42 sliding block
43 second reset spring
44 pressing block
45 third reset spring
5 control assembly
51 locking base
511 straight slot
512 inclined slot
52 locking block
521 first teeth
53 button
531 second teeth
54 fourth reset spring
6 second deflation cover

What is claimed is:

1. A bidirectional air pump, comprising a housing and a pump body, wherein an accommodating groove is defined on a side of the housing, the pump body is accommodated in the accommodating groove, a first air hole is defined on a bottom of the accommodating groove, the pump body comprises a casing and a wind assembly, the casing is hollowed-out, the wind assembly is arranged in the casing, an air inlet and an air outlet are respectively defined at two ends of the casing, and a position of the first air hole is aligned with a position of the air inlet and a position of the air outlet, wherein a first deflation cover is slidingly arranged in the first air hole in an axis direction of the first air hole, and the first deflation cover is configured for covering the first air hole, wherein a second side of the housing departing from the accommodating groove is provided with a protective cap, an outer side of the first deflation cover is covered by the protective cap, a first reset spring is arranged in the protective cap, and two ends of the first reset spring respectively abut against an inner wall of the protective cap and a first side wall of the first deflation cover departing from the accommodating groove, wherein a locking assembly is provided between the housing and the pump body, the locking assembly comprises a base, a sliding block, a second reset spring, a pressing block and a third reset spring, a received recess is defined in the housing, the base is installed in the received recess, the sliding block is slidingly arranged in the received recess in a horizontal direction and penetrates a wall of the accommodating groove, a slot is defined on a side wall of the casing, the sliding block is inserted in the slot, the sliding block is reset by the second reset spring, the pressing block is slidingly arranged in the received recess in a vertical direction, relative sliding inclined planes are provided on sides of the pressing block and the sliding block opposite to each other, and the third reset spring is configured to reset the pressing block.

2. The bidirectional air pump according to claim 1, wherein a second side wall of the first deflation cover is fixed with a sliding rod, the sliding rod slides in the axis direction of the first air hole, an ejection block is arranged in the air inlet, and the ejection block is configured for ejecting the sliding rod.

3. The bidirectional air pump according to claim 1, wherein the second side of the housing departing from the accommodating groove is provided with a convex edge, an outer side of the convex edge is covered by the protective cap, a side wall of the convex edge is provided with a limit block, a limit groove is defined on the inner wall of the protective cap, and the limit block is in snap-in connection with the limit groove.

4. The bidirectional air pump according to claim 1, wherein a second air hole is defined on the housing, the second air hole is in communication with the accommodating groove, the second air hole is covered with a second deflation cover, and the housing is provided with a control assembly for controlling the second deflation cover to open and close.

5. The bidirectional air pump according to claim 4, wherein the control assembly comprises a locking base, a locking block, a button and a fourth reset spring, the locking base is installed on an inner wall of the second air hole, a straight slot and an inclined slot are defined on an inner wall of the locking base circumferentially, a length of the straight slot is greater than a length of the inclined slot, the locking block and the button are slidingly arranged in the locking base, two ends of the fourth reset spring respectively abut against the second deflation cover and the locking block, an outer wall of the locking block and an end face of the button are respectively provided with first teeth and second teeth, the first teeth and the second teeth are meshed with each other, and the first teeth are slidable in the straight slot or the inclined slot.

6. The bidirectional air pump according to claim 1, wherein a protective cover is rotationally arranged on an outer wall of the housing, and the protective cover covers the accommodating groove.

7. The bidirectional air pump according to claim 1, wherein the pump body further comprises a lighting assembly at an end face of the casing.

* * * * *